United States Patent [19]

Lindemann et al.

[11] Patent Number: 5,012,825

[45] Date of Patent: May 7, 1991

[54] APPARATUS FOR PERFORATING RUNNING WEBS OF WRAPPING MATERIAL AND CLEANING DEVICES THEREFOR

[75] Inventors: Rolf Lindemann, Glinde; Uwe Heitmann, Hamburg, both of Fed. Rep. of Germany

[73] Assignee: Körber AG, Hamburg, Fed. Rep. of Germany

[21] Appl. No.: 275,121

[22] Filed: Nov. 22, 1988

[30] Foreign Application Priority Data

Dec. 12, 1987 [DE] Fed. Rep. of Germany ..... 3742250

[51] Int. Cl.[5] ..... A24C 5/00; A24C 5/60

[52] U.S. Cl. ..... 131/281; 219/384

[58] Field of Search ..... 131/281; 219/384

[56] References Cited

U.S. PATENT DOCUMENTS 4,236,062 11/1980 Lilly et al. ..... 131/281

4,447,708 5/1984 Allen et al. ..... 131/281

*Primary Examiner*—V. Millin

*Attorney, Agent, or Firm*—Peter K. Kontler

[57] ABSTRACT

Apparatus for perforating a running web of wrapping material, such as a web of tipping paper in a filter tipping machine for the making of filter cigarettes, is advanced through two successive electric perforating units one of which is active while the other is idle, and vice versa. This renders it possible to clean the perforating electrodes of the idle unit while the electrodes of the active unit produce sparks which remove fragments of material from the web to form one or more rows of perforations and to thus influence the permeability of the web. The apparatus can be installed in a filter tipping machine between a reel for a supply of convoluted web of tipping paper and a severing device which subdivides the leader of the perforated web into uniting bands serving to connect pairs of plain cigarettes with filter mouthpieces of double unit length.

17 Claims, 5 Drawing Sheets

37a
16a
37b
16b
37c
37d
13

37a
16a
37b
16b
37c
37d
13

(16a)
(16b)
Z
52a
(53a)
13

(16a)
A (16b)
E

Z
13

(16a)
E (16b)
A

APPARATUS FOR PERFORATING RUNNING WEBS OF WRAPPING MATERIAL AND CLEANING DEVICES THEREFOR

BACKGROUND OF THE INVENTION

The invention relates to improvements in apparatus for making perforations in running webs of paper or other wrapping material for use in connection with the production of cigarettes and/or other smokers' products. More particularly, the invention relates to improvements in apparatus for electrically perforating running webs of tipping paper or the like.

Filter tipping machines are normally equipped with apparatus for making perforations in webs which are thereupon subdivided into uniting bands serving to sealingly connect plain cigarettes with filter mouthpieces of desired length. Many presently known perforating apparatus include perforating units with pairs of holders for sets of electrodes which are connectable to a source of high voltage in order to generate sparks which burn away portions of the running web. The latter is advanced between the holders. Reference may be had, for example, to commonly owned U.S. Pat. Nos. 4,247,754 and 4,323,082, and to commonly owned published German patent application No. 32 03 103.

Apparatus of the above outlined character separate fragments of paper from selected portions of the running web. The separated fragments deposit on the electrodes and thus affect the quality of the perforating operation. Attempts to prevent the separated fragments from adhering to the electrodes include changing the polarity of the applied voltage. This merely reduces the rate at which the fragments gather on the electrodes so that the perforating apparatus must be cleaned at less frequent intervals than in the absence of changes of polarity. Nevertheless, it is necessary to shut down the perforating apparatus at certain intervals in order to permit a thorough cleaning of the electrodes and to thus ensure that the perforating operation will result in the making of a desired number of holes, i.e., in a desired increase of permeability of the web. Each interruption of operation of the perforating apparatus necessitates a stoppage of the entire machine in which the apparatus is put to use. This is highly undesirable in modern filter tipping machines which turn out many thousands of filter cigarettes or analogous smokers' products per minute. In addition, each stoppage of the filter tipping machine might necessitate a stoppage of other machines in the production line which includes a filter tipping machine. Such production line further includes one or more cigarette makers, a packing machine and a machine which provides cigarette packs with transparent outer envelopes.

OBJECTS OF THE INVENTION

An object of the invention is to provide an apparatus which is constructed and assembled in such a way that the cleaning of electrodes which make perforations in a running web of tipping paper or the like does not necessitate a stoppage of the machine in which the apparatus is put to use.

Another object of the invention is to provide filter tipping machine which embodies the above outlined apparatus.

An additional object of the invention is to provide an apparatus which permits the web to run at a full speed while the electrodes which are contaminated by fragments of paper or the like are being relieved of contaminants.

A further object of the invention is to provide novel and improved means for cleaning the electrodes of an electrical apparatus for perforating webs of tipping paper or the like.

Still another object of the invention is to provide the apparatus with novel and improved means for gathering and evacuating fragments of tipping paper or other material which are removed from a running web in the course of a perforating operation.

A further object of the invention is to provide a novel and improved method of avoiding stoppage of a running web which is in the process of being provided with perforations while the electrodes which generate sparks for the making of holes in the web are being relieved of contaminants.

SUMMARY OF THE INVENTION

The invention is embodied in an apparatus for electrically perforating a running web of wrapping material (such as cigarette paper or tipping paper) for smokers' products. The improved apparatus comprises means for advancing a web in a predetermined direction along a predetermined elongated path, a first perforating unit which is adjacent a first portion of the path, and a second perforating unit which is adjacent a second portion of the path downstream of the first portion. Each perforating unit preferably comprises first and second electrode holders which are disposed at opposite sides of the path. Furthermore, each perforating unit comprises a set of series-connected perforating electrodes, and each such set can include one or more rows which extend substantially in the predetermined direction. Each electrode on each of the first holders is preferably located opposite an electrode on the respective second holder.

The apparatus preferably further comprises means for cleaning portions of the first and second perforating units. The cleaning means preferably comprises a first cleaning device for the electrodes of the first unit, and a second cleaning device for the electrodes of the second unit. The electrodes of the first unit are connectable to an energy source independently of the electrodes of the second unit, and vice versa. This renders it possible to clean the electrodes of the first unit while the second unit is in operation, and to clean the electrodes of the second unit while the first unit is in operation.

The apparatus preferably further comprises means for opening and closing each perforating unit independently of the other unit. Such opening-closing means can comprise means for moving the first electrode holders between retracted positions more distant from and extended positions nearer to the respective second holders, and/or vice versa. The first cleaning device is preferably designed to clean the electrodes of the first unit while the first holder of the first unit is in retracted position, and the second cleaning device is preferably designed to clean the electrodes of the second unit while the first holder of the second unit is in retracted position. To this end, the apparatus further comprises means for moving the first cleaning device relative to and between the respective first and second holders, and for moving the second cleaning device relative to and between the respective second holders. Each cleaning device can comprise at least one rotary brush, preferably a plurality (e.g., a pair) of rotary cylindrical brushes.

In accordance with a presently preferred embodiment of the improved apparatus, the cleaning means comprises a mechanical cleaning device for the electrodes of each perforating unit, and a fluid-operated (particularly pneumatic) cleaning device for each perforating unit. Each pneumatic cleaning device can include a vacuum cleaner and/or means for blowing a pressurized fluid against the respective electrodes.

The apparatus can form part of or can be installed in a filter tipping machine for cigarettes and, to this end, can further comprise means for converting the perforated web into a series of uniting bands downstream of the second portion of the path. A source of convoluted web is then disposed upstream of the first portion of the path, and the advancing means comprises means for drawing the web off or from the source and for conveying it between the holders of the first and second perforating units into the range of the converting means which includes a suitable web severing device.

The first perforating unit can, but need not, be identical with the second perforating unit.

The aforementioned connecting means preferably comprises first and second means for respectively supplying to the electrodes of the first and second perforating units high-voltage impulses at a predetermined frequency, and means for connecting the supplying means with and for disconnecting the supplying means from the respective electrodes independently of each other. Such connecting-disconnecting means preferably comprises means for connecting the second supplying means with the electrodes of the second unit with a predetermined delay following disconnection of the first supplying means from the electrodes of the first unit, and means for disconnecting the second supplying means from the electrodes of the second unit with a predetermined delay following connection of the first supplying means to the electrodes of the first unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

FIGS. *7a* to *7d* are schematic representations of the mode of switching from operation with the first perforating unit to operation with the second perforating unit; and FIGS. *8a* to *8d* are schematic representations of the mode of switching from operation with the second perforating unit to operation with the first perforating unit.

DESCRIPTION OF PREFERRED EMBODIMENTS

Figure 1:
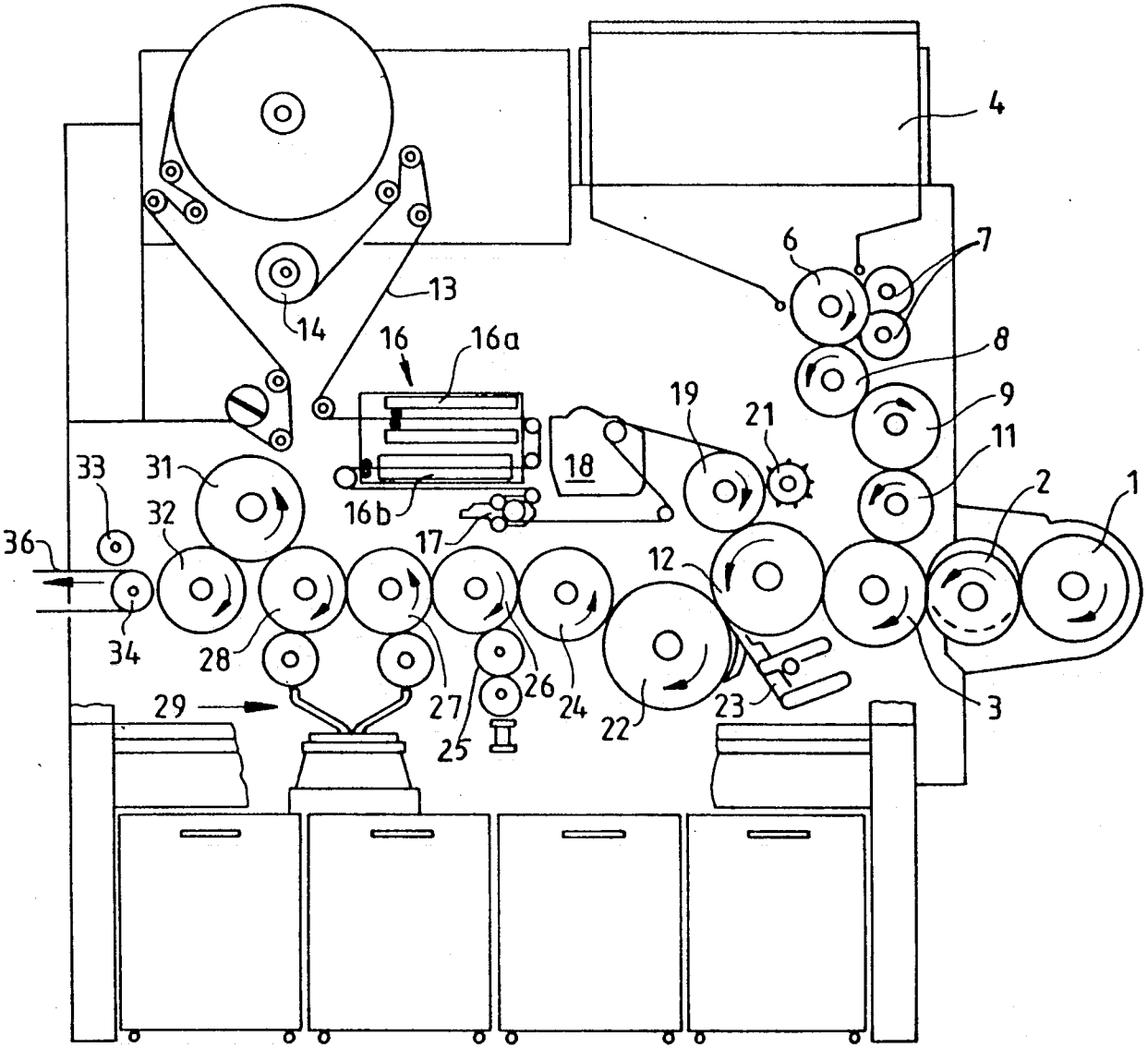
FIG. 1 is a schematic front elevational view of a filter tipping machine which is provided with a perforating apparatus embodying the present invention.

FIG. 1 shows a filter tipping machine for the making of filter cigarettes of unit length. The machine comprises a frame which supports a first drum-shaped conveyor 1 serving to accept two rows of plain cigarettes of unit length from a cigarette rod making machine, e.g., a machine known as PROTOS which is distributed by the assignee of the present application. The cigarettes of one row are staggered with reference to the cigarettes of the other row in the circumferential direction of the conveyor 1. The latter cooperates with two rotary drum-shaped aligning conveyors 2 which accept successive plain cigarettes of the respective rows and advance the accepted cigarettes at different speeds and/or through different distances so that each of a series of successive axially parallel peripheral flutes of a rotary drum-shaped assembly conveyor 3 receives from the conveyors 2 a pair of spaced-apart coaxial plain cigarettes of unit length. The width of gaps between pairs of plain cigarettes in successive flutes of the assembly conveyor 3 suffices to provide room for filter mouthpieces of double unit length.

A magazine 4 on top of the frame of the filter tipping machine contains a supply of parallel filter rod sections of six times unit length. The outlet of the magazine 4 admits such filter rod sections into the axially parallel peripheral flutes of a rotary drum-shaped severing conveyor 6 which cooperates with two rotary disc-shaped knives 7 (which are disposed one behind the other in the axial direction of the conveyor 6) to subdivide successive filter rod sections into sets of three filter mouthpieces of double unit length. Such sets are staggered on the wheels of a composite staggering conveyor 8 prior to being delivered into the flutes of a rotary drum-shaped shuffling conveyor 9 which causes the filter mouthpieces to form a single row wherein each preceding filter mouthpiece is in exact alignment with the next-following filter mouthpieces. Successive filter mouthpieces of such row are transferred onto a combined drum-shaped accelerating and inserting conveyor 11 which inserts discrete filter mouthpieces of double unit length between the pairs of plain cigarettes of unit length in successive flutes of the assembly conveyor 3. The thus obtained groups are then condensed by shifting at least one plain cigarette of each group axially toward the respective filter mouthpiece of double unit length prior to transfer of the condensed groups into successive flutes of a rotary drum-shaped intermediate or transfer conveyor 12.

The frame of the tipping machine further supports an expiring reel or bobbin 14 constituting a source of supply of a running web 13 of tipping paper which is drawn off the reel 14 by an advancing device 17 and is conveyed along an elongated path through the two units 16*a*, 16*b* of a novel electrical perforating apparatus 16. One side of the perforated web 13 is coated with adhesive during travel through a paster 18 which follows the perforating apparatus 16 and precedes a web severing device in the frame adjacent the transfer conveyor 12. The illustrated severing device comprises a suction drum 19 and a rotary knife drum 21 with axially parallel peripheral blades or knives which cooperate with the suction drum 19 to subdivide the leader of the adhesive-coated and perforated web 13 into a series of discrete uniting bands. In accordance with a feature of the invention, at least one of the perforating units 16*a*, 16*b* is operative at all times to thus ensure that each unit length of the web 13 is formed with perforations ahead of the paster 18 and the suction drum 19. That perforating unit which is not in use is ready to be cleaned so that it is ready for activation when the other perforating unit requires cleaning. The purpose of the perforating units 16*a*, 16*b* is to provide the running web 13 with perforations which form so-called climatic zones in the tubular wrappers constituting converted uniting bands and serving to connect plain cigarettes to the respective filter mouthpieces.

The advancing device 17 will be described in greater detail with reference to FIG. 2. It is located ahead of the suction drum 19 which attracts the leader of the perforated and adhesive-coated web 13 and serves as an anvil which cooperates with the knives or blades of the drum 21 to subdivide the leader of the web 13 into a series of discrete uniting bands. The drum 19 applies successive uniting bands to successive groups of plain cigarettes and filter mouthpieces in the flutes of the transfer conveyor 12 in such a way that each uniting band extends tangentially of the corresponding group and adheres to the respective filter mouthpiece of double unit length as well as to the adjacent inner end portions of the respective plain cigarettes of unit length. The uniting bands are convoluted around the respective groups during travel with a rotary drum-shaped rolling conveyor 22 which cooperates with an adjustable rolling device 23 to rotate successive groups about their respective axes and to thus convert each group into a filter cigarette of double unit length. The filter cigarettes of double unit length are transferred into the axially parallel peripheral flutes of a rotary drum-shaped drying conveyor 24 which expels moisture from the adhesive film and delivers the thus treated filter cigarettes of double unit length into successive flutes of a rotary drum-shaped severing conveyor 26 cooperating with a circular knife 25 which severs each filter cigarette midway across the respective filter mouthpiece, i.e., each filter cigarette of double unit length yields a pair of coaxial filter cigarettes of unit length which have filter mouthpieces of unit length and such filter mouthpieces are adjacent each other. Defective filter cigarettes of unit length are ejected from the severing conveyor 26, and satisfactory filter cigarettes of unit length advance into the axially peripheral flutes of a first rotary drum-shaped conveyor 27 of a turn-around device 29 of the type described in commonly owned U.S. Pat. No. 3,583,546. The purpose of the device 29 is turn the filter cigarettes of one row end-for-end and to place them between the filter cigarettes of the other row so that the rotary drum-shaped conveyor 28 of the device 29 receives and transports a single file of filter cigarettes of unit length, and the filter mouthpieces of all such filter cigarettes face in the same direction. The non-inverted filter cigarettes of unit length are transferred from the conveyor 27 into the peripheral flutes of the conveyor 28 of the turn-around device 29, and the conveyor 28 admits successive filter cigarettes of unit length (including the inverted and non-inverted filter cigarettes) into successive flutes of a rotary drum-shaped testing conveyor 31. The latter forms part of a testing device which generates signals in response to detection of defective filter cigarettes of unit length (e.g., filter cigarettes having open seams, holes in the wrappers, smudges on the wrappers and/or other defects), and all defective filter cigarettes are segregated from acceptable filter cigarettes on a rotary drum-shaped ejecting conveyor 32 which is preferably further provided with means for ascertaining the density of tobacco-containing ends of successive filter cigarettes of unit length. Defective filter cigarettes are expelled from the conveyor 32 into a suitable collecting receptable (not shown), and all acceptable filter cigarettes are delivered onto the upper reach of an endless belt conveyor 36 which is trained over pulleys 34 (only one shown) and cooperates with a braking drum 33. The conveyor 36 delivers satisfactory filter cigarettes of unit length into storage or directly to a packing machine, not shown. The conveyor 32 cooperates with one or more nozzles which discharge jets of compressed air or another gaseous fluid to segregate from acceptable filter cigarettes all such filter cigarettes which have been found to be defective during testing on the conveyor 31 and/or which have unsatisfactory tobacco-containing ends (testing on the conveyor 32 ahead of the ejecting station or stations).

Figure 2:
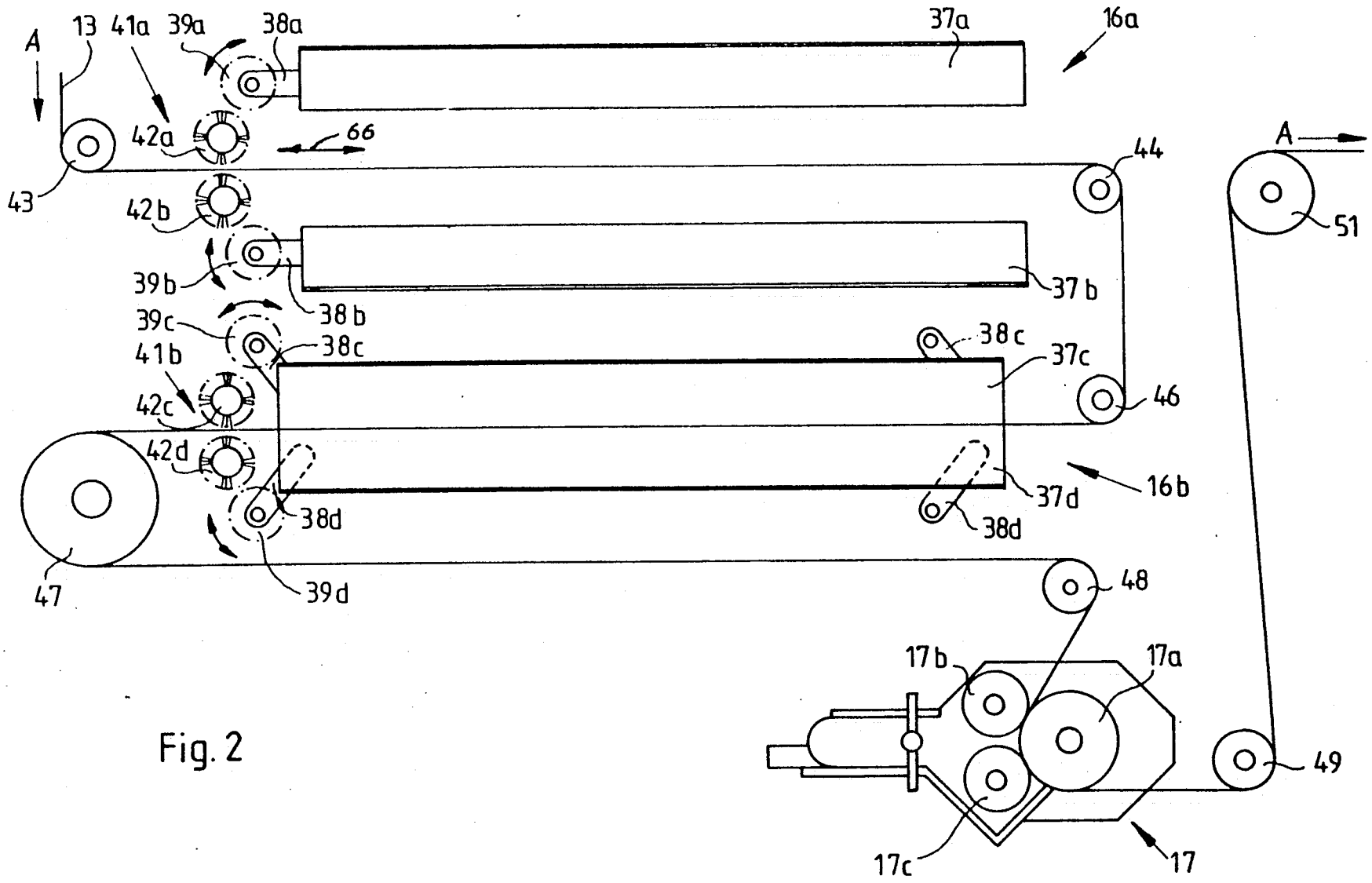
FIG. 2 is an enlarged front elevational view of the apparatus, with the electrodes omitted and with parts of the means for moving the electrode holders of the two perforating units relative to each other indicated by phantom lines.

FIG. 2 shows in greater detail certain parts of the first and second perforating units 16*a*, 16*b*, the corresponding cleaning devices 41*a*, 41*b* and the web advancing device 17. As mentioned above, the perforating unit 16*a* is operative when the perforating unit 16*b* is idle and vice versa to thus ensure that the web 13 and the filter tipping machine need not be brought to a halt when the perforating electrodes of the unit 16*b* or 16*a* require cleaning, i.e., when such electrodes are to be relieved of fragments of tipping paper which are removed from the running web 13 during travel through the active perforating unit. FIG. 2 shows that the first perforating unit 16*a* is idle and that the second perforating unit 16*b* is operative to make holes in the running web 13 while the web advances along an elongated path which is defined by the advancing means 17. The latter comprises a set of pulleys 43, 44, 46, 47, 48, 49, 51 and three rolls 17*a*, 17*b*, 17*c*. The roll 17*a* is driven in a manner not shown in FIG. 2 and cooperates with the rolls 17*b*, 17*c* to draw the web 13 off the reel 14 whereby the web advances first along a first portion of its path extending between two electrode holders 37*a*, 37*b* of the first perforating unit 16*a* and thereupon along a second path portion extending between the electrode holders 37*c*, 37*d* of the second perforating unit 16*b*. The electrode holders 37*a*, 37*b* and 37*c*, 37*d* are disposed at opposite sides of the respective portions of the path for the running web 13 and are movable between retracted positions (note the holders 37*a*, 37*b*) and extended positions (note the holders 37*c*, 37*d*) in which they are respectively more distant from and nearer to each other. The means for moving the holders 37*a*, 37*b* of the unit 16*a* between extended and retracted positions comprises arms 38*a*, 38*b* which are articulately connected to the holders 37*a*, 37*b*, and drives 39*a*, 39*b* which can pivot the arms 38*a*, 38*b* about fixed axes. When the holders 37*a*, 37*b* assume the retracted positions which are shown in FIG. 2, their electrodes 52*a*, 52*b* (on the holder 37*a*, see FIGS. 3 and 5) and 53*a*, 53*b* (on the holder 37*b*, see FIG. 5) are accessible and can be cleaned by a pair rotary cylindrical brushes 42a, 42b forming part of the first cleaning device 41a. At such time, the holders 37c, 37d of the perforating unit 16b assume the operative or extended positions which are shown in the lower part of FIG. 2 and in which they provide no room for entry of the rotary cylindrical brushes 42c, 42d of the cleaning device 41b into engagement with the electrodes 52a, 52b and 53a, 53b on the holders 37c and 37d. The means for moving the holders 37c, 37d of the unit 16b comprises arms 38c, 38d and drives 39c, 39d.

The pairs of rotary cylindrical brushes 42a, 42b and 42c, 42d constitute the mechanical cleaning devices of the means for cleaning the electrodes 52 and 53 of the perforating units 16a and 16b. The cleaning device 41a can be operated independently of the cleaning device 41b and vice versa, i.e., the electrodes of the unit 16a can be thoroughly cleaned while the unit 16b is in use, and the electrodes of the unit 16b can be thoroughly cleaned while the unit 16a is in use. This ensures that the web 13 can continue to run from the pulley 43 to the pulley 51 and thence to the suction drum 19 while the perforating unit 16a or 16b is idle. The arrows A denote the direction in which the advancing device 17 and the suction drum 19 convey the web 13 from the expiring reel 14 to the subdividing station where the leader of the web is cut up into discrete uniting bands.

The frame of the filter tipping machine further supports a fresh reel 114 containing a supply of fresh web 113 which is spliced to the trailing end of the web 13 shortly prior to expiration of the supply of web 13 on the reel 14. The manner in which the splicing operation can be carried out is described in numerous United States and foreign patents of the assignee. Reference may be had, for example, to commonly owned U.S. Pat. No. 3,586,006.

Figure 3:
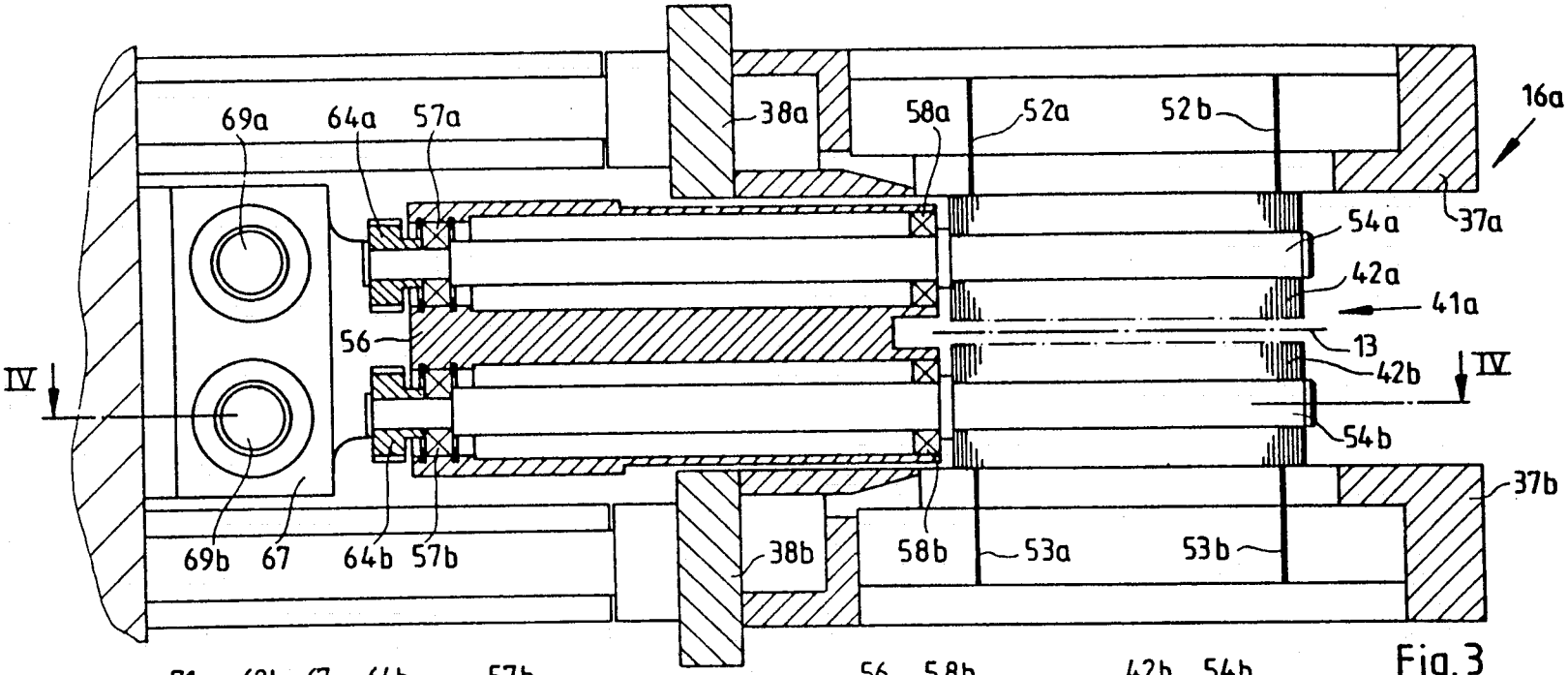
FIG. 3 is an enlarged transverse vertical sectional view of the mechanical cleaning device for the electrodes of the first perforating unit.
Figure 4:
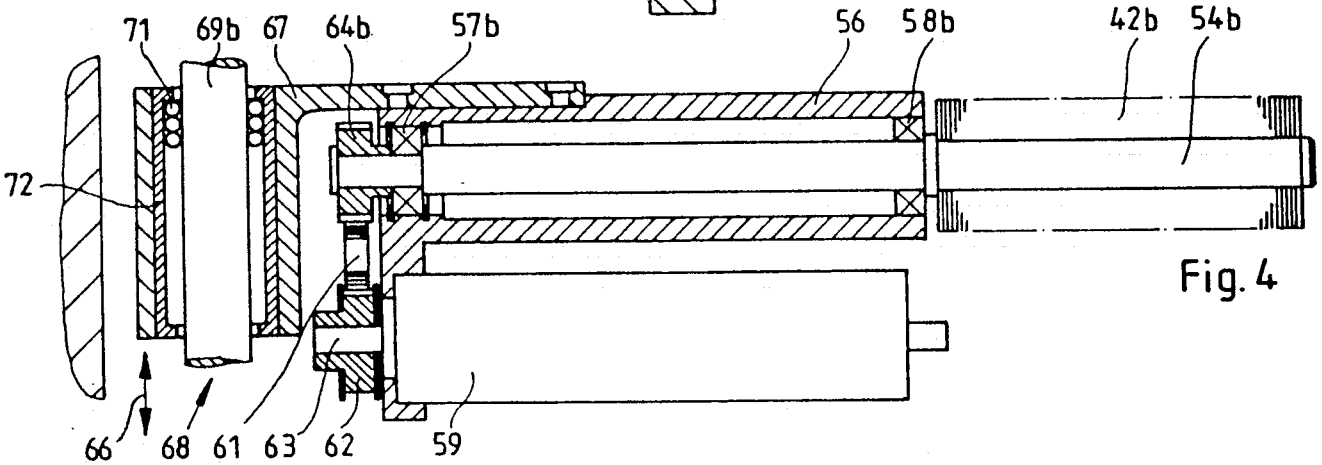
FIG. 4 is horizontal sectional view, substantially as seen in the direction of arrows from the line IV—IV of FIG. 3.

FIGS. 3 and 4 illustrate certain details of the first perforating unit 16a and of the corresponding first cleaning device 41a. The holders 37a, 37b for the electrodes 52a, 52b and 53a, 53b of the first perforating unit 16a are shown in retracted positions and the two rotary cylindrical brushes 42a, 42b of the cleaning device 41a are shown in the process of removing impurities from the electrodes 52a, 52b, 53a, 53b. The brushes 42a, 42b rotate about their respective axes and simultaneously move at right angles to such axes in a direction away from or toward the observer of FIG. 3.

The electrodes 52a, 52b form two rows which extend in the direction indicated by the arrows A of FIG. 2 and are supported by the holder 37a. The electrodes 53a, 53b also form two rows which are supported by the holder 37b and extend in the longitudinal direction of the respective portion of the path for the web 13. Each electrode 52a is disposed opposite an electrode 53a, and each electrode 52b is located opposite an electrode 53b (see also FIG. 5). The reason that the holders 37a, 37b support sets of electrodes 52a, 52b and 53a, 53b which form two rows is that the running web 13 must be provided with two groups of perforations, namely one group in or close to one marginal portion to the web and the other group in or close to the other marginal portion of the web. This ensures that the tubular connector of each filter cigarette 82 of unit length (FIG. 5) will be provided with an aerating or ventilating zone 182 consisting of one or more annuli of circumferentially extending air-admitting holes in the respective convoluted uniting band 282.

When the holders 37a, 37b of the first perforating unit 16a are returned to their extended or closed positions, and the electrodes 52a, 52b and 53a, 53b receive high-voltage impulses at a required frequency, these electrodes generate sparks which entail separation of fragments of tipping paper from the running web 13 whereby the web develops holes which serve to admit cool atmospheric air into the columns of tobacco smoke when the respective filter cigarettes are lighted.

The brush 42a of the cleaning device 41a serves to remove impurities from the electrodes 52a, 52b on the holder 37a, and the brush 42b serves to remove impurities from the electrodes 53a, 53b on the holder 37b. The brushes 42a, 42b are mounted in overhung position in a carrier 56 by means for discrete shafts 54a, 54b which are respectively rotatable in antifriction bearings 57a, 58a and 57b, 58b. The carrier 56 further supports a prime mover 59 (e.g., an electric motor or a fluid-operated motor) which transmits torque to the shafts 54a, 54b by way of a transmission including a first toothed pulley 62 on the output shaft 63 of the motor 59, toothed pulleys 64a, 64b on the shafts 54a, 54b, and an endless toothed belt 61 which is trained over the pulleys 62, 64a and 64b. The carrier 56 is mounted on a slide or carriage 67 which is reciprocable (note the double-headed arrow 66) along the path portion between the pulleys 43, 44 by a suitable drive, not specifically shown. Such drive can include a chain or belt which pulls the slide 67 in the directions indicated by arrow 66, a rack and pinion drive, a rotary feed screw, a double-acting fluid-operated (pneumatic or hydraulic) cylinder and piston unit, or the like. The means 68 for guiding the slide 67 during movement between the retracted holders 37a, 37b of the first perforating unit 16a comprises two tie rods 69a, 69b which are parallel with the rows of electrodes 52a, 52b, 53a, 53b, and sleeves 72 which contain sets of antifriction rolling elements 71 and are mounted in the slide 67 so that they surround the tie rods 69a, 69b.

The construction of means for supporting and moving the brushes 42c, 42d of the cleaning device 41b for the electrodes 52a, 52b and 53a, 53b on the holders 37c, 37d of the second perforating unit 16b is or can be identical with that of the means for moving the brushes 42a, 42b of the cleaning device 41a.

Figure 5:
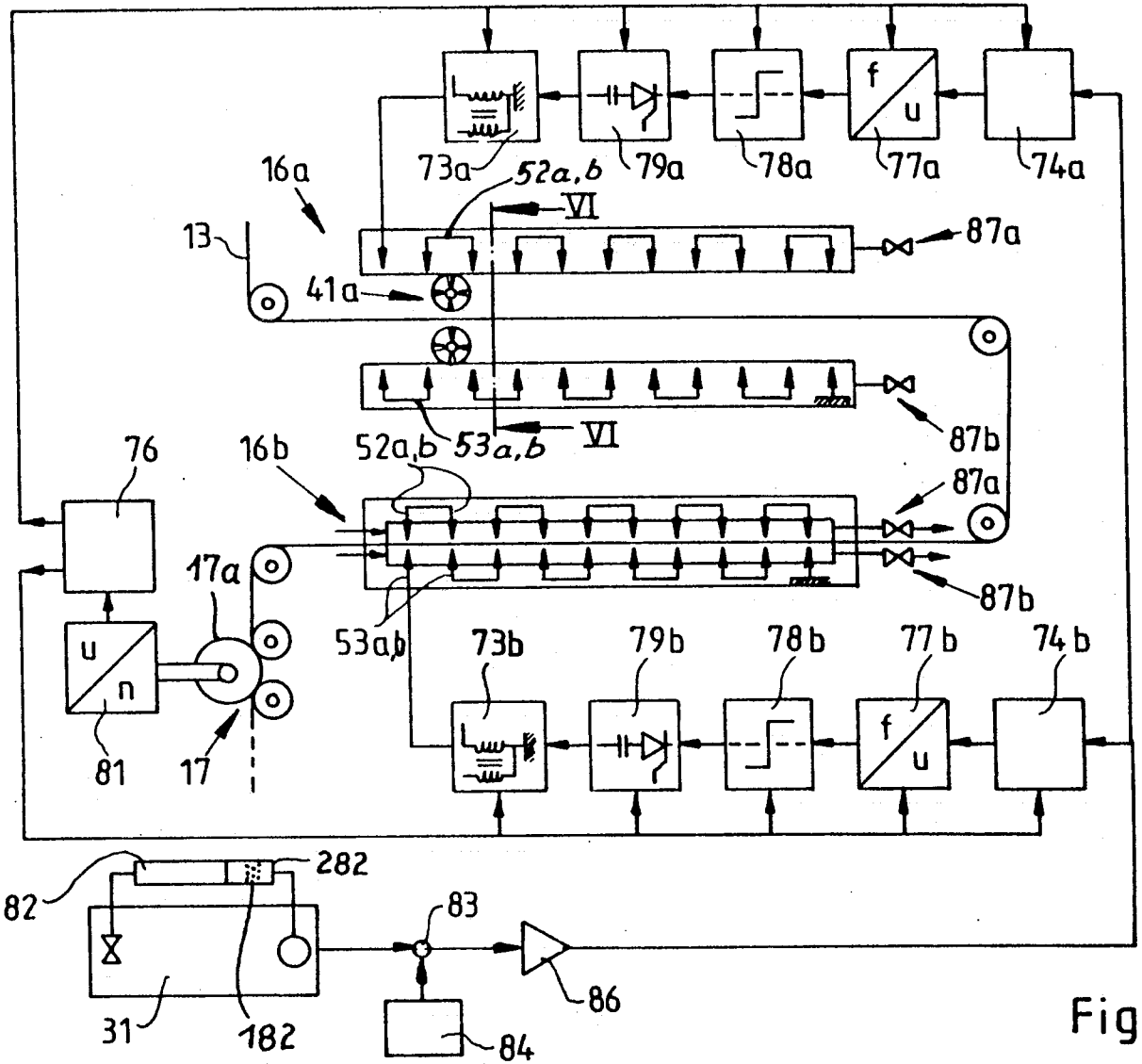
FIG. 5 illustrates the means for supplying high-voltage impulses to the electrodes of the two perforating units.

FIG. 5 shows the circuits of the electrodes 52a, 52b and 53a, 53b on the holders 37a, 37b and 37c, 37d of the perforating units 16a and 16b. The electrodes are shown schematically by arrows, and they are connected in series. This ensures that sparks which are generated by the electrodes traverse the path for the web 13 in a direction from an electrode 52a or 52b on the holder 37b, thereupon from an electrode 53a or 53b toward the aligned electrode 52a or 52b and so forth. The sources of high-voltage energy include discrete transformers 73a, 73b for the electrodes of the perforating units 16a, 16b. In order to transmit high-voltage impulses for the electrodes 52a, 52b and 53a, 53b of the first perforating unit 16a at an optimum frequency, the latter further comprises a regulator 74a which receives signals from the testing unit including the conveyor 31 and from a means for monitoring the speed of the running web 13. The regulator 74a transmits signals to a voltage-frequency converter 77a which also receives signals from the aforementioned speed monitoring means and transmits signals to a Schmitt trigger 78 which receives signals from the speed monitoring means and serves to transmit signals to the input of a thyristor-capacitor switch 79a. The switch 79a receives signals from the speed monitoring means and transmits signals to the transformer 73*a*. The Schmitt trigger 78*a* generates rectangular output signals at a required frequency. The second perforating unit 16*b* comprises the aforementioned transformer 73*b*, a regulator 74*b*, a voltage-frequency converter 77*b*, a Schmitt trigger 78*b* and a thyristor-capacitor switch 79*b*. Thus, the unit 16*b* can operate independently of the unit 16*a*, and vice versa.

The test device including the conveyor 31 ascertains the permeability of the wrappers of successive satisfactory filter cigarettes 82 and transmits corresponding signals to a signal comparing stage 83 which further receives reference signals from a suitable source 84, e.g., from an adjustable potentiometer. Such reference signals denote the desired permeability of the wrappers, and the stage 83 transmits output signals when the monitored permeability of the wrappers of filter cigarettes 82 deviates from the desired permeability (reference value) to a predetermined extent. Such signals are amplified at 86 and are transmitted to the corresponding inputs of the regulators 74*a* and 74*b*.

The means for monitoring the speed of the running web 13 comprises a programmed computer 76 having a first output connected with the corresponding inputs of the regulator 74*a*, voltage-frequency converter 77*a*, Schmitt trigger 78*a*, switch 79*a* and transformer 73*a*, and a second output connected with the corresponding inputs of the regulator 74*b*, voltage-frequency converter 77*b*, Schmitt trigger 78*b*, switch 79*b* and transformer 73*b*. The input of the computer 76 is connected with the output of an RPM-voltage transducer 81 which ascertains the RPM of the roll 17*a* forming part of the web advancing device 17. The signal from the transducer 81 is a voltage signal which is processed by the computer 76, and the processed signal is transmitted to the aforedescribed components of circuits for the electrodes of the perforating units 16*a* and 16*b*.

A testing unit which can be used in the filter tipping machine of FIG. 1 and includes a testing conveyor corresponding to the conveyor 31 of FIGS. 1 and 5 is disclosed, for example, in commonly owned U.S. Pat. No. 4,193,409.

Signals which are transmitted from the testing device including the conveyor 31 to the signal comparing stage 83 of FIG. 5 denote the so-called degree of ventilation of the wrappers of filter cigarettes 82. This degree is indicative of the ratio of air entering the lighted filter cigarette 82 by way of the innate or artificially (electrically) produced perforations or pores to the flow of all flowable substances through the filter cigarette.

FIG. 5 shows that the means for cleaning the electrodes on the holders 37*a*, 37*b* and 37*c*, 37*d* of the perforating units 16*a*, 16*b* can further comprise fluid-operated (particularly pneumatic) cleaning devices. The pneumatic cleaning device of cleaning means for the electrodes of the perforating unit 16*a* comprises at least two suction nozzles 87*a*, 87*b* which can be said to form part of a vacuum cleaner and are designed to gather fragments of paper and/or other impurities which float in the space between the retracted holders 37*a*, 37*b*, especially as a result of mechanical cleaning action of the rotating brushes 42*a*, 42*b*. A similar pneumatic cleaning device (also including nozzles 87*a*, 87*b*) forms part of the means for cleaning the electrodes of the perforating unit 16*b* in retracted positions of the respective holders 37*c* and 37*d*. Of course, the nozzles 87*a*, 87*b* are disconnected from the suction generally device (not shown) when the respective holders 37*a*, 37*b* or 37*c*, 37*d* are maintained in the extended positions.

Figure 6:
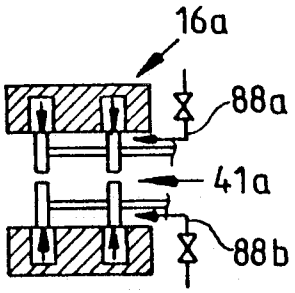
FIG. 6 is a sectional view substantially as seen in the direction of arrows from the line VI—VI of FIG. 5.

If desired, necessary or practical, the vacuum cleaners including the nozzles 87*a*, 87*b* can be replaced by or used jointly with pneumatic cleaning devices which include nozzles or other suitable means for discharging jets of pressurized fluid serving to expel impurities from the space between the retracted electrode holders. Vacuum cleaners are preferred at this time because they can gather the impurities instead of expelling them into the area around the respective (inactive) perforating unit. FIG. 6 shows nozzles 88*a*, 88*b* which can be used in addition to or in lieu of the upper nozzles 87*a*, 87*b* of FIG. 5 to expel contaminants from the space between the retracted holders 37*a*, 37*b* of the perforating unit 16*a*. The main function of the pneumatic cleaning devices (including the nozzles 87*a*, 87*b* and/or 88*a*, 88*b*) is to collect or expel impurities which are separated from the electrodes during movement of the brushes 42*a*, 42*b* or 42*c*, 42*d* between the respective (retracted) electrode holders 37*a*, 37*b* or 37*c*, 37*d*.

Figures 7A, 7B, 7C, 7D, 8A, 8B, 8C, 8D:
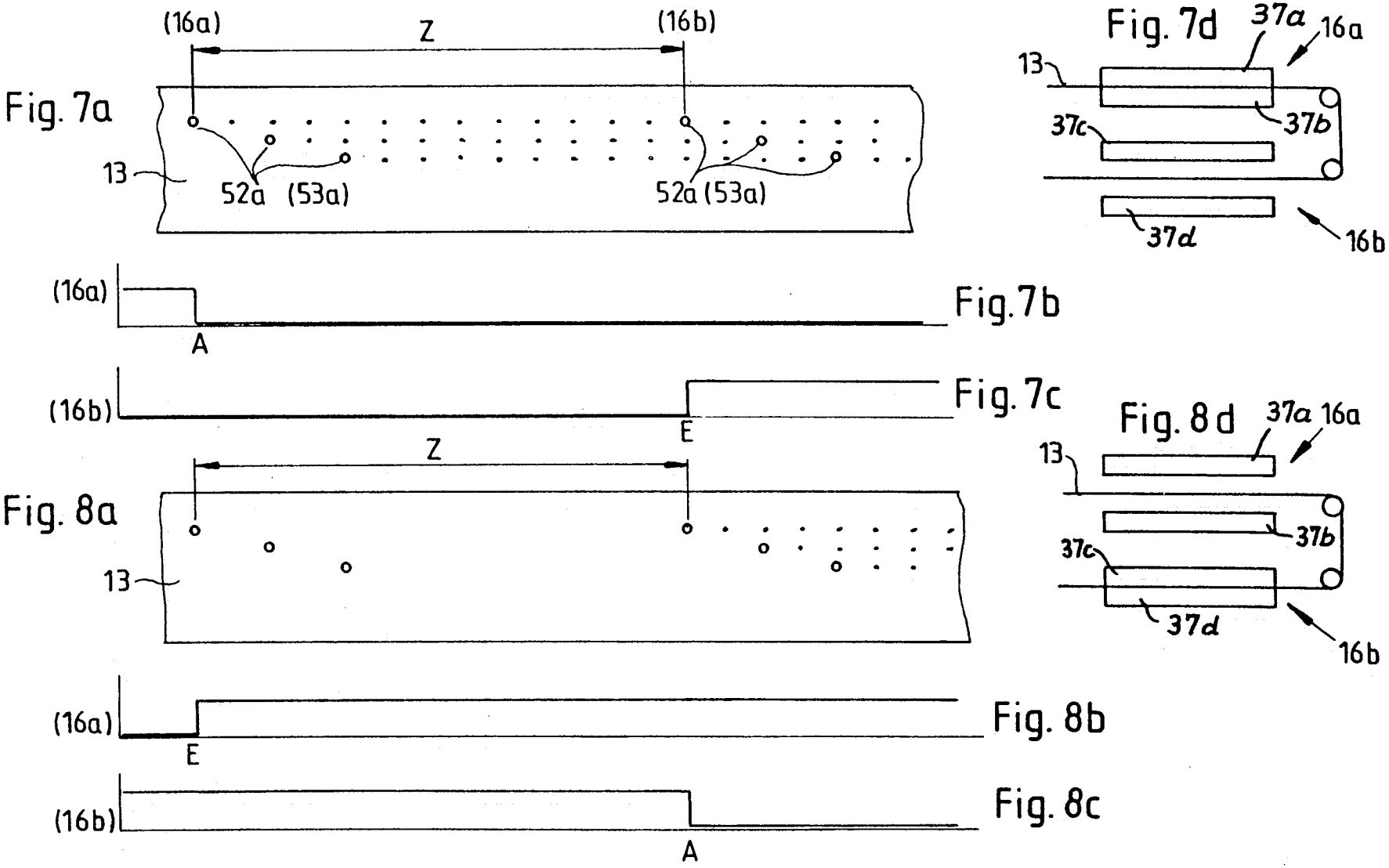

FIGS. 7*a* to 7*d* illustrate the presently preferred mode of timing the restarting of the freshly cleaned perforating unit 16*b* with reference to stoppage of the (yet to be cleaned) perforating unit 16*a*. FIG. 7*a* shows a length of the running web 13 which extends from the space between the holders 37*a*, 37*b* of the perforating unit 16*a* into the space between the holders 37*c*, 37*d* of the perforating unit 16*b*. The character Z denotes the distance between the last perforations which were formed by the electrodes 52*a*, 52*b*, 53*a*, 53*b* of the unit 16*a* prior to stoppage (deactivation) of this unit and the locus where the electrodes of the unit 16*b* are to begin to form perforations in response to starting of the unit 16*b*. This distance Z corresponds to the length of that portion of the web 13 which is to yield a number of uniting bands 282 for attachment of pairs of plain cigarettes of unit length to filter mouthpieces of double unit length.

The first step of conversion from operation with the first perforating unit 16*a* to operation with the second perforating unit 16*b* includes turning off the unit 16*a* at the instant A (FIG. 7*b*). When the web 13 has covered the distance Z, the second unit 16 is started at the instant E (note the diagram of FIG. 7*c*) with a predetermined delay following stoppage of the unit 16*a* at the instant A. This ensures that the web portion between A and E is not formed with an excessive number of perforations, i.e., that the permeability of the corresponding uniting bands 282 will not exceed the desired value which would be the case if the unit 16*b* were permitted to perforate that portion of the running web 13 which was already perforated by the unit 16*a*. FIG. 7*d* shows schematically that stage of operation when the holders 37*a*, 37*b* of the unit 16*a* are still held in the extended positions and the holders 37*c*, 37*d* of the unit 16*b* are still held in the retracted positions.

FIGS. 8*a* to 8*d* show the preferred mode of selecting the timing of activation of the first perforating unit 16*a* and the timing of deactivation of the second perforating unit 16*b*. The first step includes activating the perforating unit 16*a* (i.e., moving the holders 37*a*, 37*b* from the retracted positions of FIG. 8*d* to the extended positions of FIG. 7*d*) prior to stoppage of the second unit 16*b*. The instant of activation of the unit 16*a* is shown at E (see the diagram of FIG. 8*b*), and the instant of opening or deactivation of the unit 16*b* is shown at A (note the diagram of FIG. 8*c*). Thus, the running web 13 is perforated by the unit 16*b* simultaneously with the unit 16*a* during the interval which elapses while the web covers the distance Z (FIG. 8*a*). This ensures that the unit **16*b* can perforate that portion of the web 13 which extends between the units 16*a*, 16*b* at the time when the unit 16*a* is restarted. FIG. 8*d* shows the holders 37*a*, 37*b* of the unit 16*a* in retracted positions, and the holders 37*c*, 37*d* of the unit 16*b*** in extended positions.

The just described modes of switching from operation with the first perforating unit **16*a* to operation with the second perforating unit 16*b* or vice versa ensure that the filter tipping machine does not or need not produce any rejects during the interval immediately following or immediately preceding activation or deactivation of the perforating unit 16*a* or 16*b***.

FIGS. **7*a* and 8*a* show that the electrodes of the units 16*a* and 16*b* are staggered relative to each other in the longitudinal direction of the web 13. This is often desirable or necessary because the electrodes on a holder 37 cannot be placed too close to one another. The illustrated electrodes are designed to form three rows of perforations adjacent one marginal portion of the web 13**.

An important advantage of the improved apparatus and of the machine which embodies the apparatus is that the running web need not be arrested when the electrodes of the one or the other perforating unit require cleaning. All that is necessary is to maintain one of the perforating units **16*a*, 16*b*** in a state of readiness (i.e., with its electrodes clean) while the other unit is in actual use, and vice versa. The provision of discrete cleaning devices for the two perforating units renders it possible to clean the inactive perforating unit, either immediately following retraction of the respective holders or shortly prior to deactivation of the other unit, i.e., of the unit which must be deactivated because its electrodes have accumulated a certain amount of foreign matter which would be likely to adversely affect the perforating operation.

While it would suffice to provide each perforating unit with a stationary electrode holder and a second electrode holder which is movable relative to the stationary electrode holder, it is presently preferred to provide each perforating unit with means for moving both electrode holders between extended and retracted positions. This simplifies the cleaning operation, especially with the mechanical cleaning devices including the pairs of brushes **42*a*, 42*b* and 42*c*, 42*d***.

The improved apparatus can be used with equal or similar advantage for the making of perforations in a running web outside of a filter tipping machine, e.g., in the plant which makes reels 14, 114 for delivery to a cigarette making plant.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for electrically perforating a running web of wrapping material for smokers' products, comprising means for advancing a web in a predetermined direction along a predetermined path; a first perforating unit adjacent a first portion of said path; and a second perforating unit adjacent a second portion of said path downstream of said first portion, each of said units comprising first and second electrode holders disposed at opposite sides of said path and at least one row of perforating electrodes on each of said holders, said rows extending substantially in said predetermined direction and each electrode on each of said first holders being located opposite an electrode on the respective second holder, the distribution of electrodes in said first unit with reference to said path being substantially identical with the distribution of electrodes in said second unit with reference to said path so that one of said units can be operated to perforate the running web while the other of said units is idle without altering the perforating action upon the web.

2. The apparatus of claim 1, further comprising means for cleaning portions of said units.

3. The apparatus of claim 1, and further comprising means for selectively connecting the electrodes of said first and second units with an energy source independently of each other.

4. The apparatus of claim 3, further comprising a first cleaning device for the electrodes of said first unit and a second cleaning device for the electrodes of said second unit.

5. The apparatus of claim 1, further comprising means for opening and closing each of said units independently of each other.

6. The apparatus of claim 1, further comprising first and second cleaning devices for portions of said first and second units, respectively, each of said devices comprising at least one rotary brush.

7. The apparatus of claim 6, wherein each of said devices comprises a plurality of brushes.

8. The apparatus of claim 1, further comprising means for converting the perforated web into uniting bands for use in a filter tipping machine downstream of the second portion of said path.

9. The apparatus of claim 1, wherein said first and second units further comprise first and second means for respectively supplying to the electrodes of said first and second units high-voltage impulses at a predetermined frequency.

10. The apparatus of claim 9, further comprising means for connecting said supplying means with and for disconnecting said supplying means from the respective sets of electrodes independently of each other, including means for connecting said second supplying means with the second set of electrodes with a predetermined delay following disconnection of said first supplying means from the first set of electrodes.

11. The apparatus of claim 9, further comprising means for connecting said supplying means with and for disconnecting said supplying means from the respective sets of electrodes independently of each other, including means for disconnecting said second supplying means from the second set of electrodes with a predetermined delay following connection of said first supplying means with said first set of electrodes.

12. The apparatus of claim 1, further comprising a source of convoluted web upstream of said first portion and a web severing device downstream of said second portion of said path.

13. Apparatus for electrically perforating a running web of wrapping material for smokers' products, comprising means for advancing a web in a predetermined direction along a predetermined path; a first perforating unit adjacent a first portion of said path; a second perforating unit adjacent a second portion of said path downstream of said first portion, each of said units comprising first and second electrode holders disposed at opposite sides of said path; and means for opening and closing each of said units independently of each other, including means for moving said first holders between retracted positions more distant from and extended positions nearer to the respective second holders.

14. The apparatus of claim 13, further comprising perforating electrodes provided on said holders, and means for cleaning said electrodes including a first cleaning device for the electrodes on the holders of said first unit, a second cleaning device for the electrodes on the holders of said second unit, and means for moving said devices relative to and between the respective holders in the retracted positions of the respective first holders.

15. Apparatus for electrically perforating a running web of wrapping material for smokers' products, comprising means for advancing a web in a predetermined direction along a predetermined path; a first perforating unit adjacent a first portion of said path; a second perforating unit adjacent a second portion of said path downstream of said first portion, each of said units comprising a plurality of perforating electrodes; and means for cleaning said electrodes including first and second mechanical cleaning devices for the electrodes of said first and second units, respectively, and first and second pneumatic cleaning device for the electrodes of said first and second units, respectively.

16. The apparatus of claim 15, wherein said pneumatic cleaning devices include vacuum cleaners.

17. The apparatus of claim 15, wherein said pneumatic cleaning devices include means for blowing a pressurized fluid against the respective electrodes.

* * * * *